US007717277B2

(12) United States Patent
Meinhardt

(10) Patent No.: US 7,717,277 B2
(45) Date of Patent: May 18, 2010

(54) ROTATABLE TOOL ORGANIZER

(76) Inventor: Christopher L. Meinhardt, 1238 Littlefield Dr., New Port Richey, FL (US) 34655

( * ) Notice: Subject to any disclaimer, the term of this patent is extended or adjusted under 35 U.S.C. 154(b) by 529 days.

(21) Appl. No.: 11/367,803

(22) Filed: Mar. 3, 2006

(65) Prior Publication Data

US 2007/0205166 A1 Sep. 6, 2007

(51) Int. Cl.
*A47F 7/00* (2006.01)
*A47F 5/02* (2006.01)
*B65D 85/28* (2006.01)

(52) U.S. Cl. ..... 211/70.6; 211/70; 206/373; 312/330.1

(58) Field of Classification Search ..... 211/10, 211/70.6, 78, 126.1, 163, 53, 56, 58, 70, 211/95, 129.1, 131.1, 144; 206/1.7, 349, 206/372, 373, 141, 142, 143, 163, 169, 198, 206/200, 506, 210; 312/201, 218, 327, 328, 312/330.1, 334.1, 334.7, 334.8; 108/167, 108/171

See application file for complete search history.

(56) References Cited

U.S. PATENT DOCUMENTS

| | | | | | |
|---|---|---|---|---|---|
| 88,281 | A | * | 3/1869 | Montigny | 108/167 |
| 217,286 | A | * | 7/1879 | Hetfield | 105/253 |
| 559,929 | A | * | 5/1896 | Bunner | 108/167 |
| D26,184 | S | * | 10/1896 | Burnett | D6/440 |
| 1,352,490 | A | * | 9/1920 | Wilkins | 211/69 |
| 1,405,495 | A | * | 2/1922 | Cook | 211/45 |
| 1,503,746 | A | * | 8/1924 | Claytor | 312/140.3 |
| 1,586,826 | A | * | 6/1926 | Michelbach | 211/70 |
| 1,643,477 | A | * | 9/1927 | Warren | 211/69.4 |
| 1,704,122 | A | * | 3/1929 | Cohen | 206/368 |
| 1,718,996 | A | | 7/1929 | Blocker | |
| 1,761,453 | A | * | 6/1930 | Rankin | 312/244 |
| 1,859,352 | A | * | 5/1932 | Albee | 47/39 |
| 1,972,681 | A | * | 9/1934 | Duncan | 101/133 |
| 2,086,091 | A | * | 7/1937 | Payette | 296/100.09 |
| 2,136,843 | A | * | 11/1938 | Dinkel | 312/280 |
| 2,541,845 | A | * | 2/1951 | Traeger | 242/137 |
| D169,077 | S | * | 3/1953 | Mains, Jr. | D6/469 |
| 2,683,642 | A | * | 7/1954 | Stoleson | 312/244 |
| 3,047,350 | A | * | 7/1962 | Eckstein | 312/300 |
| 3,077,977 | A | * | 2/1963 | Wood | 206/1.7 |
| 3,092,428 | A | | 6/1963 | Kerschner | |
| 3,231,730 | A | * | 1/1966 | Wagner | 362/154 |
| 3,259,230 | A | * | 7/1966 | Jaeger | 206/373 |
| 3,298,532 | A | * | 1/1967 | Wilcke | 211/70.6 |

(Continued)

FOREIGN PATENT DOCUMENTS

GB 2196321 A * 4/1988

*Primary Examiner*—Michael Safavi
*Assistant Examiner*—Joshua Rodden
(74) *Attorney, Agent, or Firm*—Larson & Larson, P.A.; Frank Liebenow

(57) ABSTRACT

A tool organizer is disclosed for supporting and organizing a variety of tools. The tool caddy includes a circular base that rests upon a lazy susan bearing, allowing 360 degree rotation of the tool caddy. The tool caddy includes shaped openings in the circular base for storing tools such as sockets, a central raised platform for resting larger tools, and a drawer beneath the central raised platform for storing smaller parts and tools. There are screwdriver holders at the end of the drawer and a bridge above the central raised platform for storing additional tools.

17 Claims, 14 Drawing Sheets

U.S. PATENT DOCUMENTS 3,302,594 A * 2/1967 Barnett et al. ..... 108/139
3,367,483 A * 2/1968 Studen ..... 206/379
3,464,564 A * 9/1969 MacNalley ..... 211/10
3,489,289 A * 1/1970 Scott-Fenton ..... 211/78
3,691,647 A * 9/1972 Snyder et al. ..... 34/104
3,777,882 A * 12/1973 McIntyre ..... 206/370
3,833,255 A * 9/1974 Logue ..... 296/101
3,858,529 A * 1/1975 Salladay ..... 108/103
3,966,052 A * 6/1976 Knaus ..... 211/70.6
4,126,366 A * 11/1978 Handler et al. ..... 312/249.2
4,269,124 A * 5/1981 Rosenthal et al. ..... 108/103
4,294,348 A * 10/1981 Hastings ..... 206/1.7
4,305,511 A * 12/1981 Denholtz ..... 211/70
D279,950 S * 8/1985 Wan ..... D7/640
4,585,266 A * 4/1986 Steinberg ..... 296/100.1
4,635,894 A * 1/1987 Sammons ..... 248/558
4,696,516 A * 9/1987 Yeum ..... 297/452.37
4,826,007 A * 5/1989 Skeie ..... 206/373
4,884,701 A * 12/1989 Nymark et al. ..... 211/69.8
4,901,846 A * 2/1990 Lehman ..... 206/1.8
4,947,998 A * 8/1990 Smeller ..... 211/70.6
4,998,698 A * 3/1991 Martinson ..... 248/176.2
5,080,322 A * 1/1992 Harley ..... 248/349.1
5,148,917 A * 9/1992 LeBrun ..... 206/372
D354,989 S * 1/1995 West ..... D19/85
5,377,850 A * 1/1995 Liaw ..... 211/163
5,379,885 A 1/1995 Chen
5,405,077 A 4/1995 Damon
D361,223 S * 8/1995 Sanson ..... D6/457
5,479,867 A * 1/1996 Blevins et al. ..... 108/94
5,511,662 A * 4/1996 Amoroso et al. ..... 206/373
5,515,969 A * 5/1996 Schonenbach ..... 206/373
5,595,228 A * 1/1997 Meisner et al. ..... 144/285
5,641,080 A * 6/1997 Humphrey et al. ..... 211/77
5,669,498 A * 9/1997 Fierek et al. ..... 206/373
5,672,145 A * 9/1997 Pollington et al. ..... 483/59
5,678,693 A * 10/1997 Tapp et al. ..... 206/454
D393,550 S * 4/1998 Jay ..... D6/434
5,893,572 A * 4/1999 Parks ..... 280/47.18
5,894,944 A * 4/1999 Swift ..... 211/78
D413,491 S * 9/1999 McCauley ..... D7/600.2
D414,001 S * 9/1999 Crotte et al. ..... D28/73
6,026,954 A * 2/2000 Marsh ..... 206/372
6,105,768 A 8/2000 Brown
6,176,540 B1 * 1/2001 Whittaker ..... 296/100.02
6,182,839 B1 * 2/2001 Robbins et al. ..... 211/78
6,206,493 B1 * 3/2001 Sanchez-Levin et al. .... 312/125
6,209,723 B1 * 4/2001 Fields ..... 206/373
6,345,830 B1 * 2/2002 Chavez ..... 280/47.28
6,360,891 B1 * 3/2002 Rideout ..... 206/373
6,394,566 B1 * 5/2002 Slivon et al. ..... 312/323
6,439,406 B1 * 8/2002 Duhon ..... 211/131.1
6,568,646 B2 * 5/2003 Wess et al. ..... 248/349.1
6,648,166 B2 * 11/2003 Levy ..... 220/520
6,648,282 B1 * 11/2003 Sykes ..... 248/118
D490,848 S * 6/2004 Pope et al. ..... D19/36
6,905,020 B2 6/2005 Chang
6,938,766 B1 * 9/2005 Lee ..... 206/388
6,945,442 B2 9/2005 Godshaw et al.
6,997,512 B1 * 2/2006 Yu ..... 297/344.26
7,225,633 B2 * 6/2007 DeMars ..... 62/457.6
7,334,844 B2 * 2/2008 Barackman et al. .... 297/452.17
D566,646 S * 4/2008 Whittaker ..... D12/414.1
2001/0024192 A1 * 9/2001 Lewis ..... 345/163
2005/0109717 A1 * 5/2005 Armstrong ..... 211/39
2005/0189787 A1 * 9/2005 Chernoff et al. ..... 296/187.01
2005/0224433 A1 * 10/2005 Heneveld ..... 211/70.6

* cited by examiner

*FIG. 10*
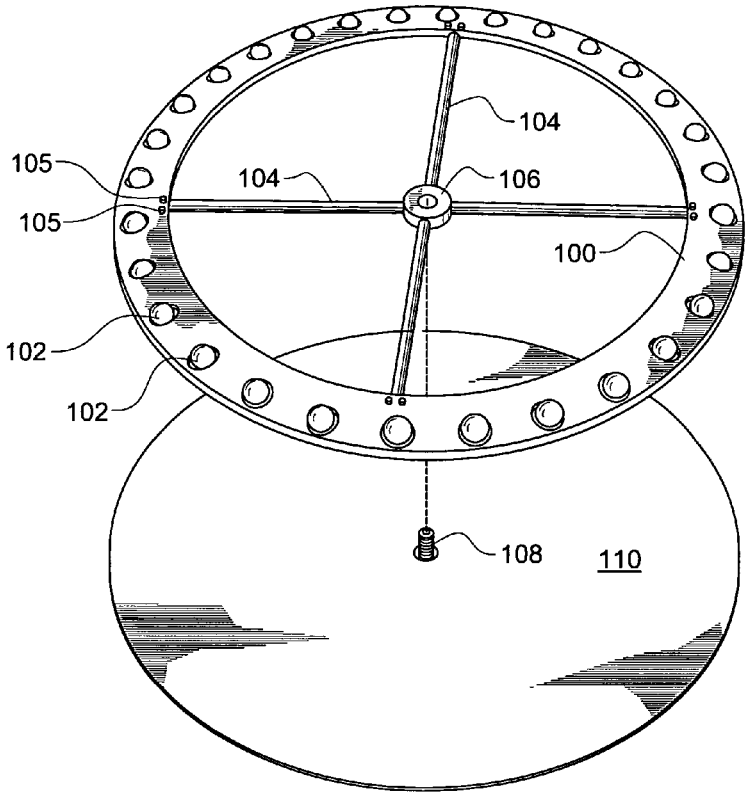
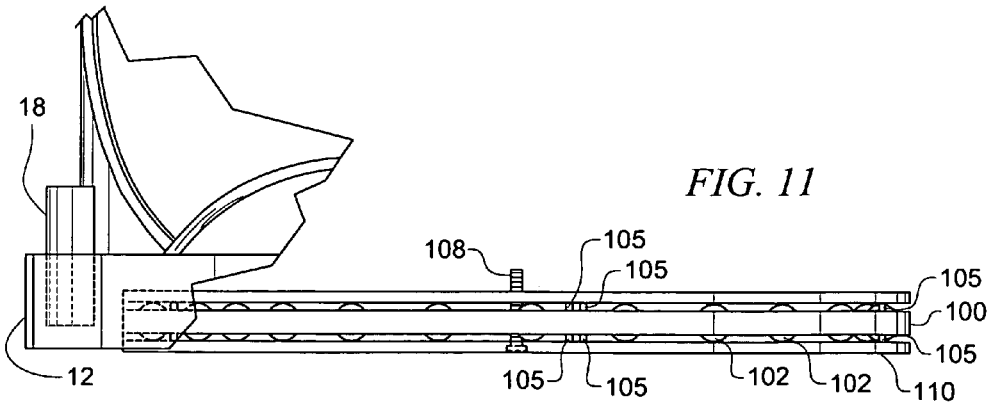
*FIG. 11*

ROTATABLE TOOL ORGANIZER

BACKGROUND OF THE INVENTION

1. Field of the Invention

The present invention relates to tool storage devices and more particularly pertains to a tool carrier for supporting, carrying and organizing tools.

2. Description of the Related Art

The use of tool carrying and storage devices is known in the prior art. For example, a tool rack is described in U.S. Pat. No. 6,105,768 to Ivan J. Brown. Tool racks such as these are designed for primarily stationary use. Furthermore, U.S. Pat. No. 6,945,442 to Donald E. Godshaw, et al., describes a soft sided tool carrier, suitable for carrying tools organized in compartments. While these devices fulfill their respective, particular objectives and requirements, they do not disclose a tool rack that provides for tool storage in a stationary position such as on a work bench, while allowing the tool rack to be carried for remote use.

What is needed is a tool organizer for storing tools that rotates on a workbench for easy access of all sides.

SUMMARY OF THE INVENTION

In one embodiment, a tool caddy is disclosed including a circular base resting on a bearing, the bearing allowing rotation. There are shaped openings around a top surface of the circular base for holding tools and components. A central raised platform extends upwardly from the circular base and at least one angled surface goes between the top surface of the circular base and the central raised platform for holding larger tools. Two risers extend from the circular base at each end of the central raised platform, higher than the raised central platform and a bridge is affixed to the risers. The bridge is parallel to and above the central raised platform and is adapted to hold additional tools.

In another embodiment, a tool caddy is disclosed including a circular base resting on a lazy susan bearing, the lazy susan bearing allowing rotation of the circular base. Shaped openings are disposed around the top surface of the circular base for holding tools and components. There is a central raised platform extending upwardly from the circular base and a drawer adapted to be inside the central raised platform, the drawer extending outwardly from the central raised platform for providing access to the drawer's contents. There is at least one angled surface adapted to be between the top surface of the circular base and the central raised platform for holding larger tools, with two risers extending from the circular base at each end of the central raised platform, the risers extending higher than the raised central platform. A bridge is affixed to the risers; the bridge is parallel to and above the central raised platform, the bridge being adapted to hold additional tools.

In another embodiment, a tool caddy is disclosed including a circular base resting on a lazy susan bearing. The lazy susan bearing has a circular retainer ring rotatably interfaced with the circular base through a hub and a plurality of support rods. A plurality of balls are situated in a plurality of holes in the circular retainer ring and the circular retainer ring is situated between the circular base and a lazy susan bottom plate thereby holding the balls in place; the balls allow a rotation of the circular base. Shaped openings are situated around a top surface of the circular base for holding tools or components. A central raised platform extends upwardly from the circular base and a drawer fits inside the central raised platform. There is at least one angled surface between the top surface of the circular base and the central raised platform for holding larger tools and two risers extending from the circular base at each end of the central raised platform, the risers extending higher than the raised central platform. A bridge is attached to the risers, parallel to and above the central raised platform, the bridge is adapted to hold additional tools.

BRIEF DESCRIPTION OF THE DRAWINGS

The invention can be best understood by those having ordinary skill in the art by reference to the following detailed description when considered in conjunction with the accompanying drawings in which:

FIG. 10 illustrates an exploded view of the base of the tool caddy of the present invention.

FIG. 11 illustrates a cutaway view of the base of the tool caddy of the present invention.

DETAILED DESCRIPTION OF THE INVENTION

Figure 1:
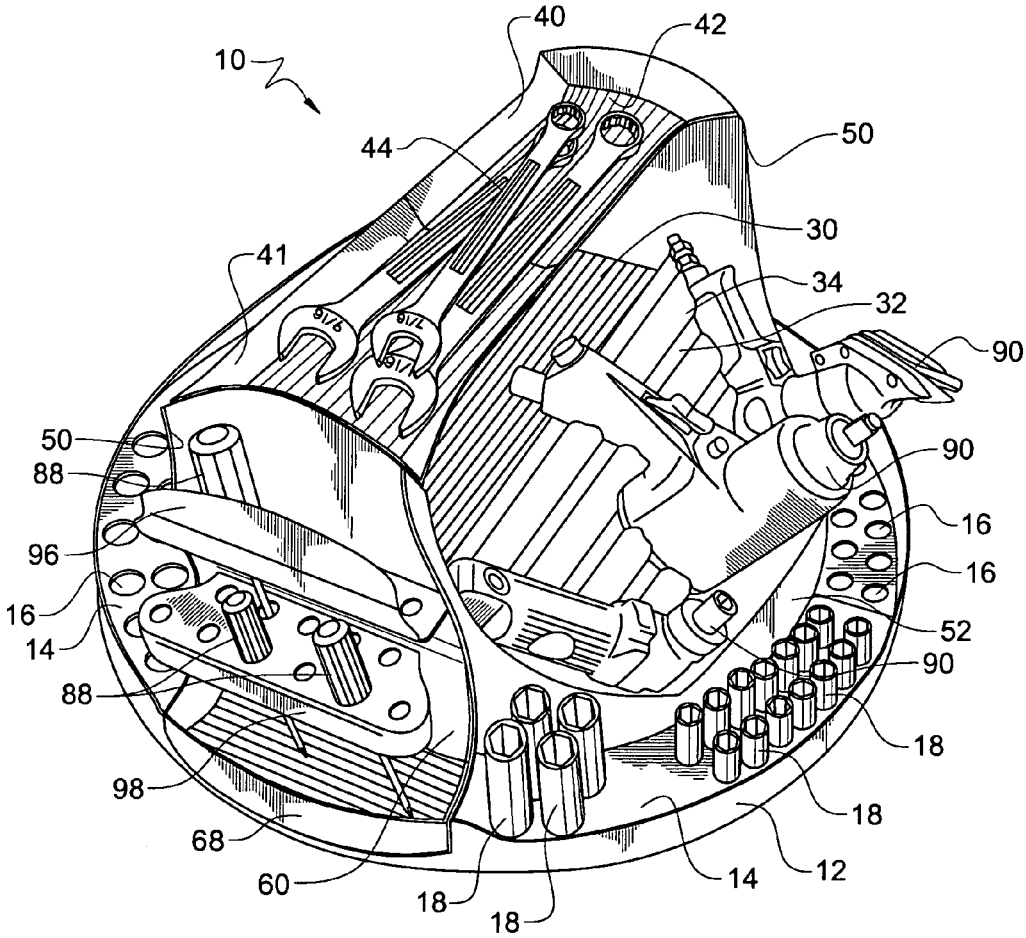
FIG. 1 illustrates a perspective view of a tool caddy of the present invention populated with tools.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a tool caddy 10 of the present invention populated with tools is shown. The tool caddy 10 is formed of a circular base 12 that has a top surface 14 covering a cavity between the top surface 14 and the circular base 12. There are shaped openings 16 cut in the top surface 14 for organizing and storing tools or components such as drill bits and sockets 18. The tool caddy 10 can also be used to carry and organize artist supplies. In that mode, the shaped openings 16 hold artist supplies or components such as paint and chalk. Central to the circular base 12 is a central raised platform 30. Between the central raised platform 30 and the top surface 14 of the circular base 12 is one or two angled surfaces 32. In some embodiments, the central raised platform 30 and the angled surfaces 32 are covered with a non-skid surface such as rubber to allow tools 90 to rest without sliding. In some embodiments, the angled surfaces 32 are covered with a memory material 34 that conforms to the shape of the tools 90, thereby supporting the tools 90 in position. The memory material 34 is, for example, a soft rubber bladder filled with sand or filled with memory foam.

Two risers 50 rise from the circular base 12 and there is a bridge 40/41 connecting their two top edges. In the preferred embodiment, the bridge 40/41 is covered with a non-skid material 42 such as ribbed rubber. Several tools 44 are shown stored on the bridge 40/41. On one side, an optional drawer 60 is under the central raised platform 30. An upper screwdriver holder 96 and a lower screwdriver holder 98 are affixed to the end of the drawer 60 for holding screwdrivers 88. A small tray 68 is formed at the end of the drawer 60 for holding small parts and allowing for a grip for pulling out the drawer 60. In some embodiments, a tool resting surface 52 is formed, allowing larger tools 90 to rest without interfering with the smaller tool parts 18. In some embodiments, the tool resting surface 52 is covered with a rubber material or leather to prevent scrapes on tools. In some embodiments, the tool resting surface 52 is curved, providing a range of positions for resting the larger tools 90.

Figure 2:
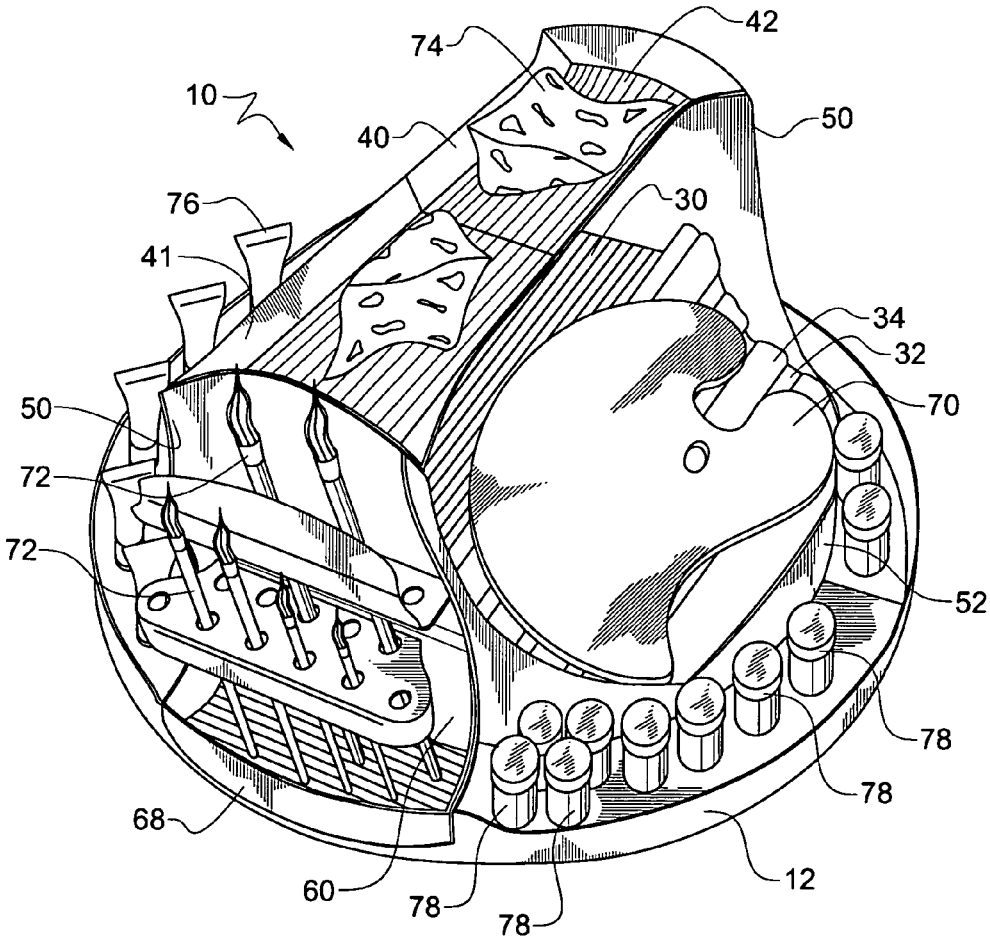
FIG. 2 illustrates a perspective view of a tool caddy of the present invention populated with art supplies.

Referring to FIG. 2, a perspective view of a tool caddy of the present invention populated with art supplies is shown. The tool caddy 10 is formed of a circular base 12 as in FIG. 1. The circular base 12 has a top surface 14 covering a cavity between the top surface 14 and the circular base 12. There are shaped openings 16 cut in the top surface 14 for organizing and storing art supplies or components such as paint bottles 78 and tubes of paint 76. Central to the circular base 12 is a central raised platform 30. Between the central raised platform 30 and the top surface 14 of the circular base 12 is one or two angled surfaces 32. In some embodiments, the central raised platform 30 and the angled surfaces 32 are covered with a non-skid surface such as rubber to allow art supplies 70 to rest without sliding. In some embodiments, the angled surfaces 32 are covered with a memory material 34 that conforms to the shape of the art supplies 70, thereby supporting them in position. The memory material 34 is, for example, a soft rubber bladder filled with sand or filled with memory foam. In this use of the tool caddy 10, the screwdriver holders 96/98 hold artist paint brushes 72.

Figure 3:
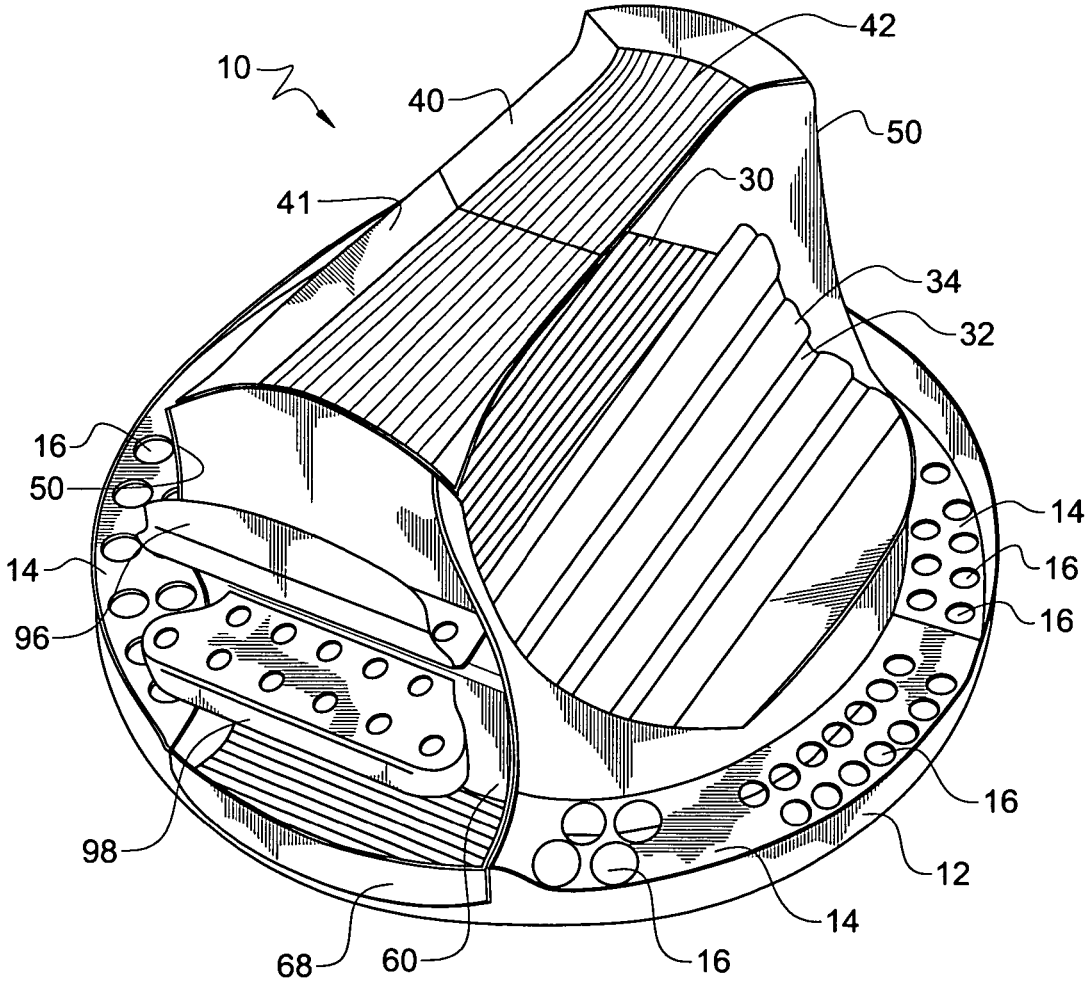
FIG. 3 illustrates a perspective view of a tool caddy of the present invention without tools.

Referring to FIG. 3, a perspective view of a tool caddy of the present invention without tools is shown. Various shaped openings 16 in the top surface 14 of the circular base 12 are shown. In some embodiments, the size of the shaped openings 16 matches the size of the tools or components that are carried. For example, the shaped openings may fall in a range of sizes that match the outer dimension of individual sockets, drills or paint bottles. In some embodiments, the shapes of the shaped openings 16 are circular while in other embodiments, the shape matches the designated tool. As an example, the shape of the openings 16 would be hexagonal for allen wrenches.

Figure 4:
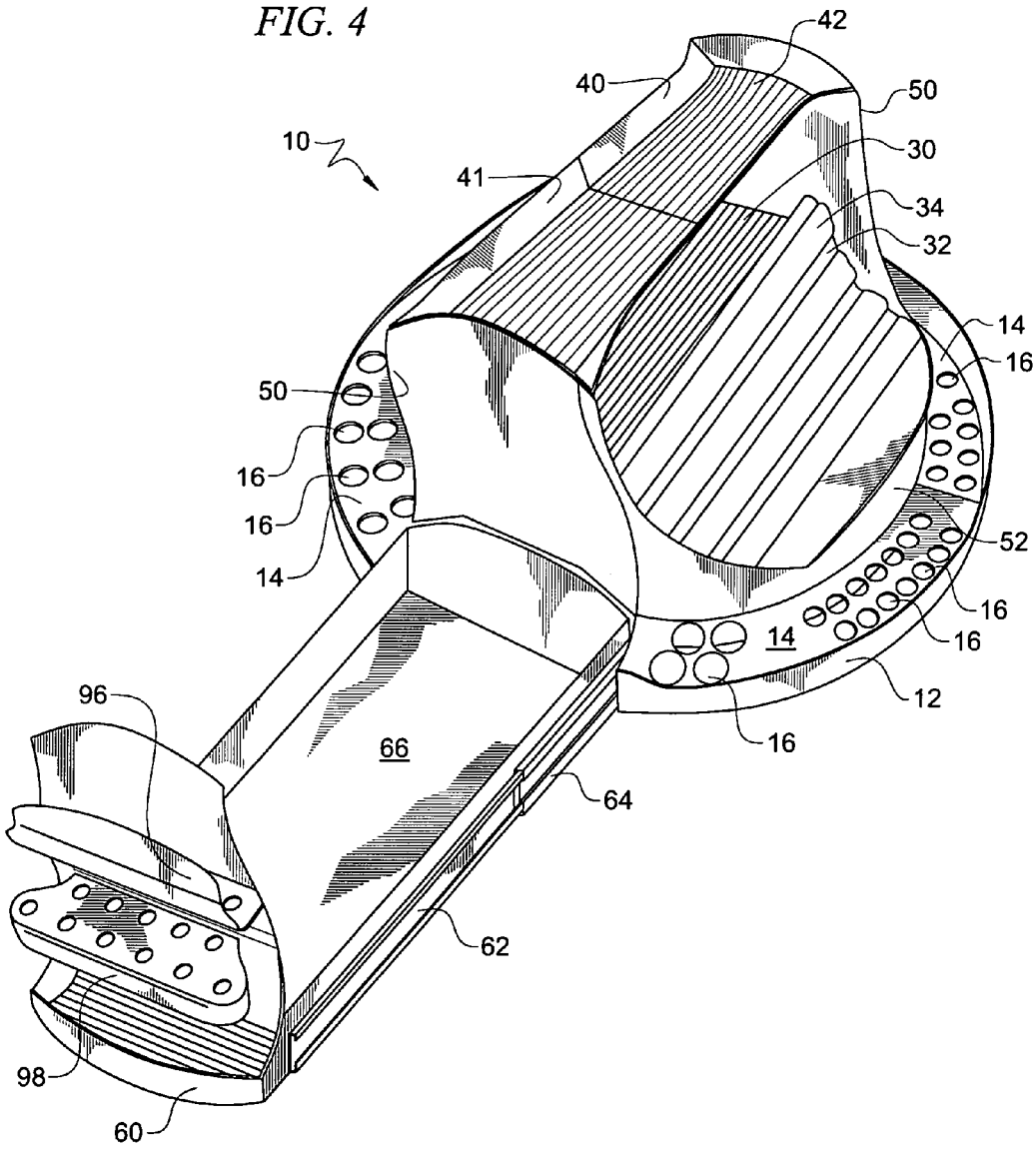
FIG. 4 illustrates a perspective view of a tool caddy of the present invention showing the optional slide out drawer.

Referring to FIG. 4, a perspective view of a tool caddy of the present invention showing the optional slide out drawer is shown. The drawer 60 fits under the central raised platform 30 and has space 66 for storing tools. In the preferred embodiment, the drawer 60 interfaces with the sides of the central raised bridge with drawer gliders 62/64 which are commonly used in kitchen cabinets. In some embodiments, the drawer 60 has no gliders.

Figure 5:
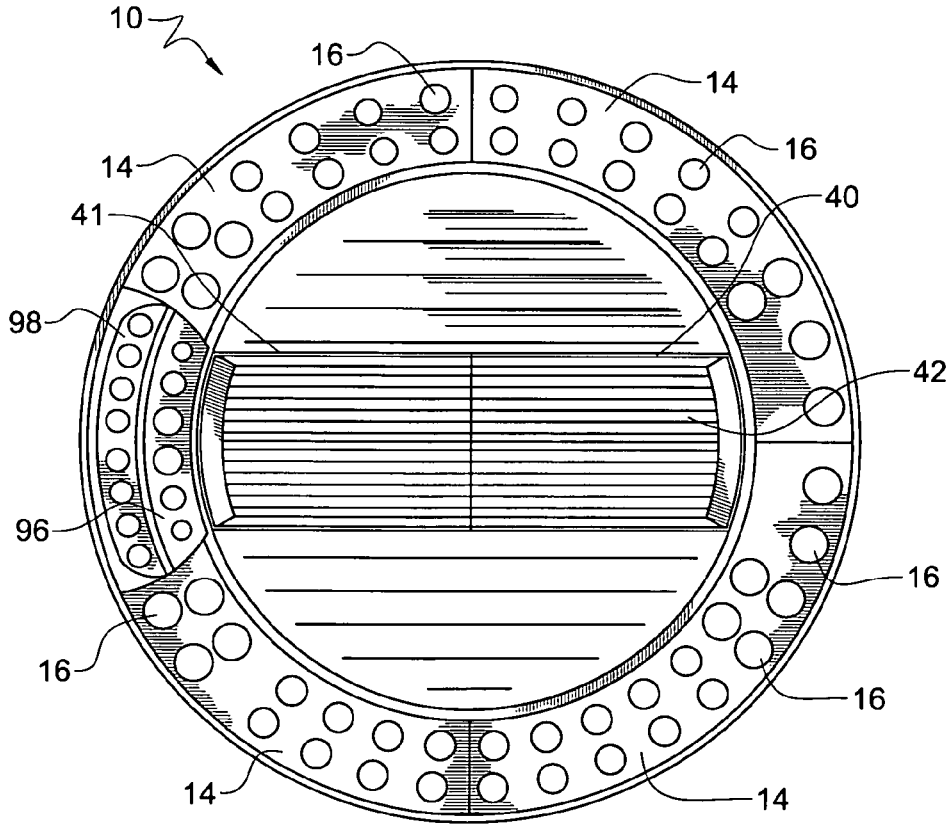
FIG. 5 illustrates a world plan view of a tool caddy of the present invention.

Referring to FIG. 5, a world plan view of a tool caddy of the present invention is shown. Visible are the shaped openings 18 in the top surface 14 for holding tools, the bridge 40/41 and its rubber surface 42. Also visible are the upper screwdriver holder 96 and a lower screwdriver holder 98. In an alternate embodiment, an optional second upper and lower screwdriver holder 96/98 is attached at the opposite side.

Figure 6:
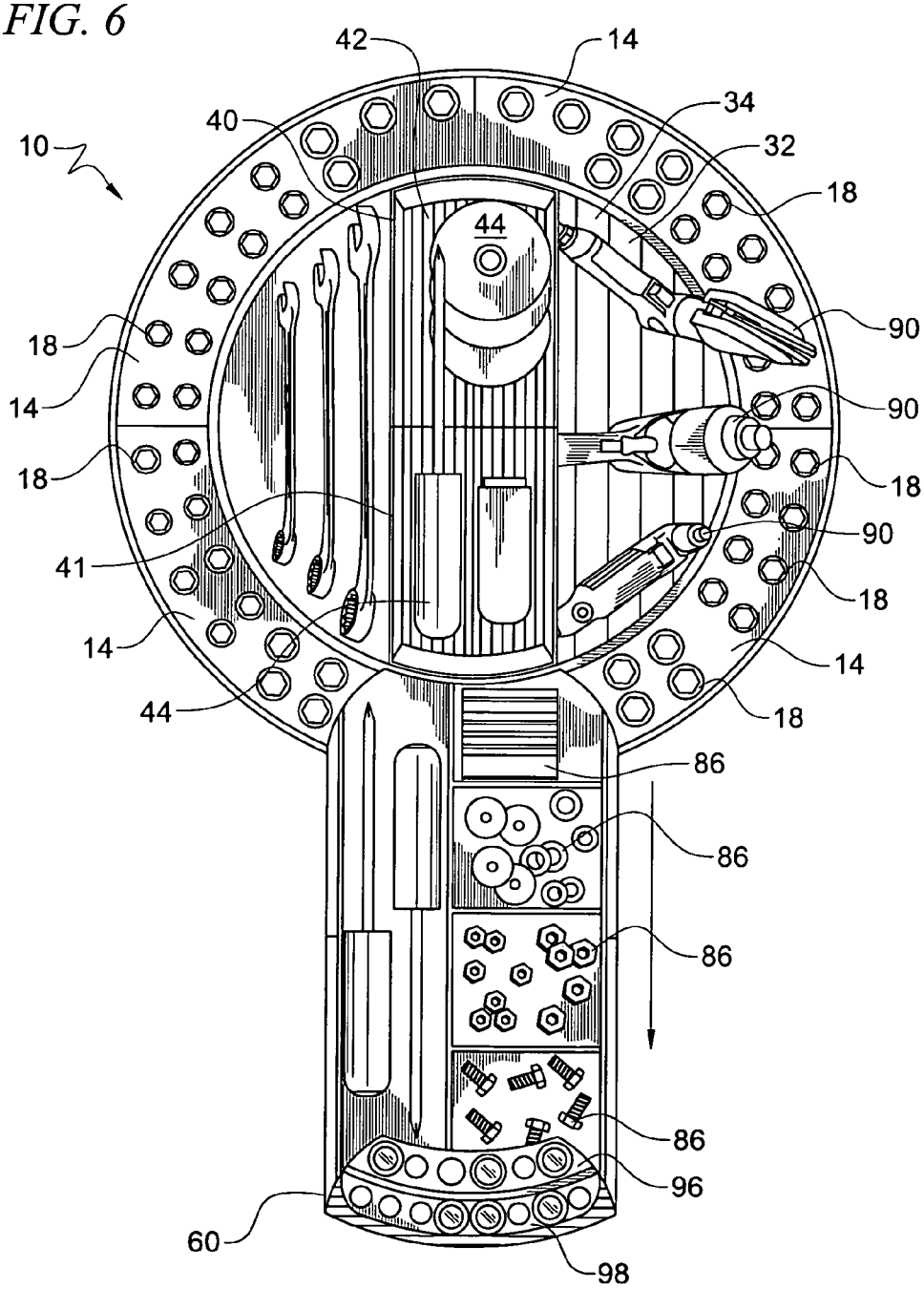
FIG. 6 illustrates a world plan view of a tool caddy of the present invention with the optional slide out drawer.

Referring to FIG. 6, a world plan view of a tool caddy of the present invention with the optional slide out drawer is shown. The drawer 60 is shown holding various smaller parts or components 86. It can be seen that the upper screwdriver holder 96 and the lower screwdriver holder 98 are affixed to the end of the drawer 60.

Figure 7:
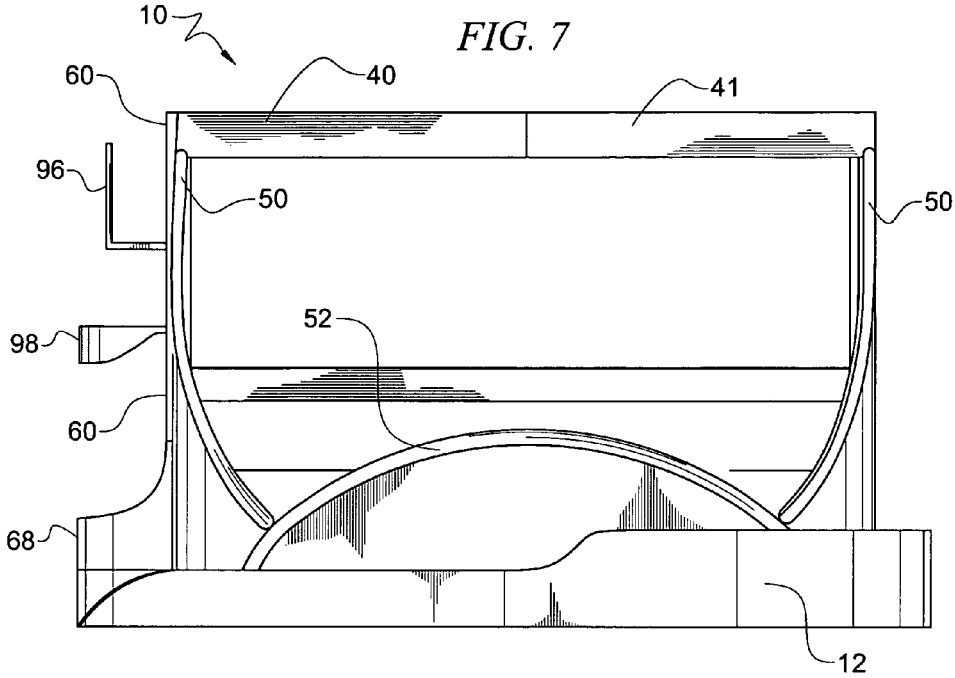
FIG. 7 illustrates a right side view of a tool caddy of the present invention.

Referring to FIG. 7, a right side view of a tool caddy of the present invention is shown. The upper screwdriver holder 96 and the lower screwdriver holder 98 are affixed to the end of the drawer 60 and the drawer handle 68 is visible. In some embodiments, a tool resting surface 52 is formed, allowing larger tools 90 to rest without interfering with the smaller tool parts 18. In some embodiments, the tool resting surface 52 is covered with a rubber material or leather to prevent scrapes on tools. In some embodiments, the tool resting surface 52 is curved, providing a range of positions for resting the larger tools 90.

Figure 8:
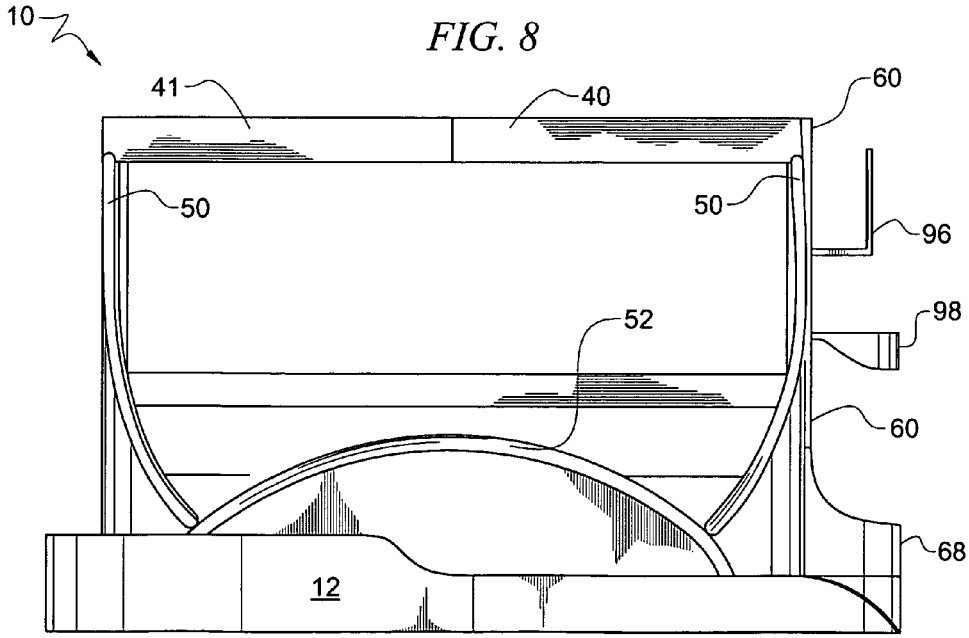
FIG. 8 illustrates a left side view of a tool caddy of the present invention.

Referring to FIG. 8, a left side view of a tool caddy of the present invention is shown. The upper screwdriver holder 96 and the lower screwdriver holder 98 are affixed to the end of the drawer 60 and the drawer handle 68 is visible. In some embodiments, a tool resting surface 52 is formed, allowing larger tools 90 to rest without interfering with the smaller tool parts 18. In some embodiments, the tool resting surface 52 is covered with a rubber material or leather to prevent scrapes on tools. In some embodiments, the tool resting surface 52 is curved, providing a range of positions for resting the larger tools 90.

Figure 9:
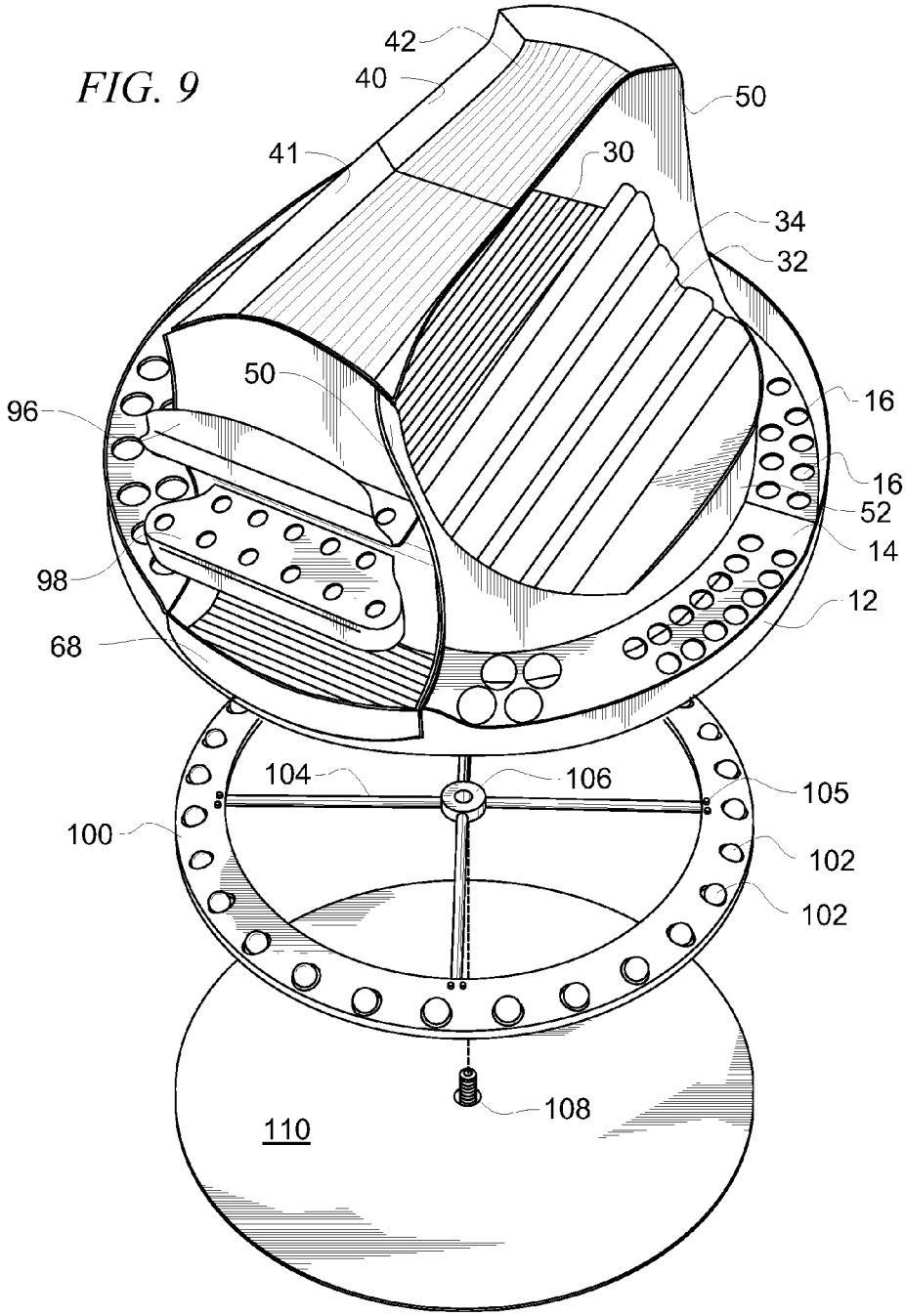
FIG. 9 illustrates an exploded view of a tool caddy of the present invention.

Referring to FIG. 9, an exploded view of a tool caddy of the present invention is shown. In this view, the lazy susan type of bearing is visible. The lazy susan bearing allows for the rotation of the tool caddy 10. There are many ways known to make a lazy susan bearing, but in the preferred embodiment, the lazy susan bearing is made of a lazy susan retainer ring 100 with a plurality of lazy susan balls 102 held in circular holes of the lazy susan retainer ring 100, sandwiched between the bottom surface of the circular base 12 and the bottom lazy susan plate 110. The lazy susan retainer ring 100 is connected to a lazy susan central hub 106 by a plurality of lazy susan support rods 104 and the lazy susan is held together by a fastener 108 passing through the lazy susan bottom plate 110, the lazy susan hub 106 and affixed to the circular base 12. Also shown are lazy susan stabilizers 105 that are small protrusions formed on the top and bottom surface of the lazy susan retainer ring 100. It is preferred that the top-to-bottom width of the lazy susan stabilizers 105 be slightly less than the diameter of the lazy susan balls 102 so that the weight of the tool caddy 10 is supported by the lazy susan balls 102 instead of the lazy susan stabilizers 105. The lazy susan balls 102 are made from a hard material such as steel, wood or plastic.

Referring to FIG. 10, an exploded view of the base of the tool caddy of the present invention is shown without the main section of the tool caddy, thereby showing the entire circumference of the lazy susan retainer ring 100 and all of the lazy susan balls 102.

Referring to FIG. 11, a cutaway view of the base of the tool caddy of the present invention is shown. It can be seen that the lazy susan has a diameter less than that of the circular base 12, allowing for deeper storage of tools 18.

Figure 12:
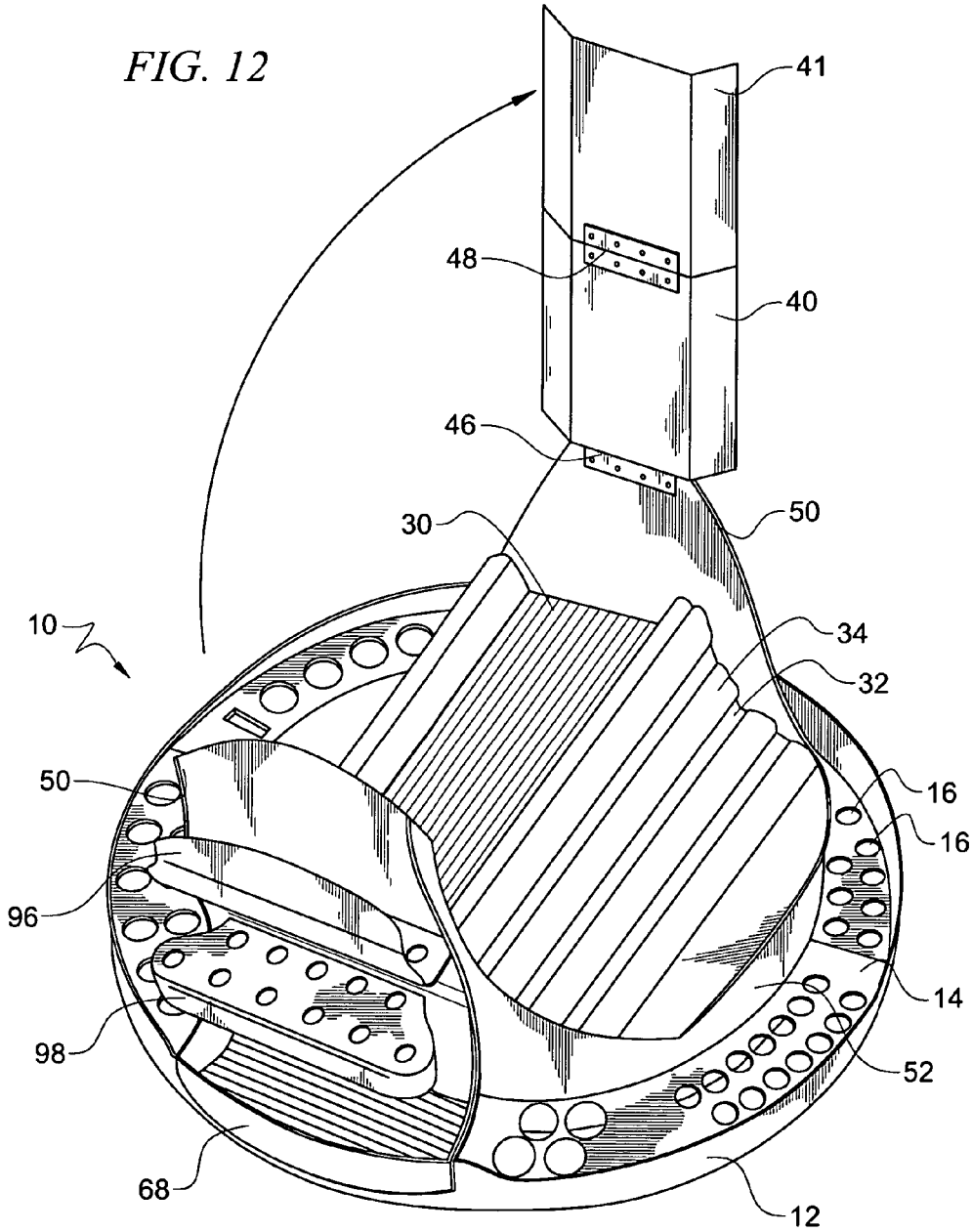
FIG. 12 illustrates a first view of the flying bridge of the tool caddy of the present invention.
Figure 13:
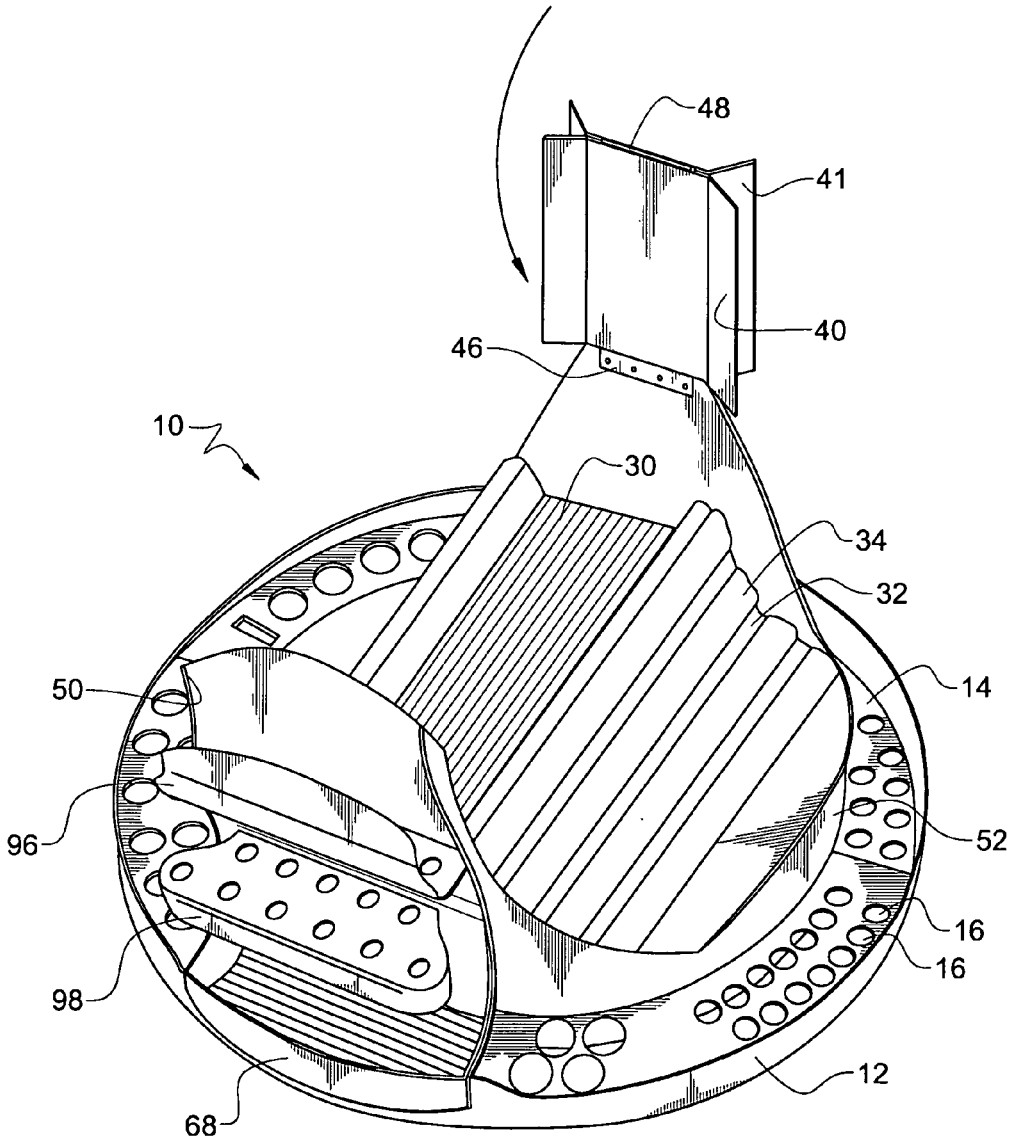
FIG. 13 illustrates a second view of the flying bridge of the tool caddy of the present invention.

Referring to FIG. 12, a first view of the flying bridge of the tool caddy of the present invention is shown. The bridge sections 40/41 are attached to one of the risers 50 by a hinge 46, allowing the bridge 40/41 to be lifted, thereby exposing the entire central raised platform 30. A central hinge 48 allows for the bridge 40/41 to be folded in half as shown in FIG. 13.

Figure 14:
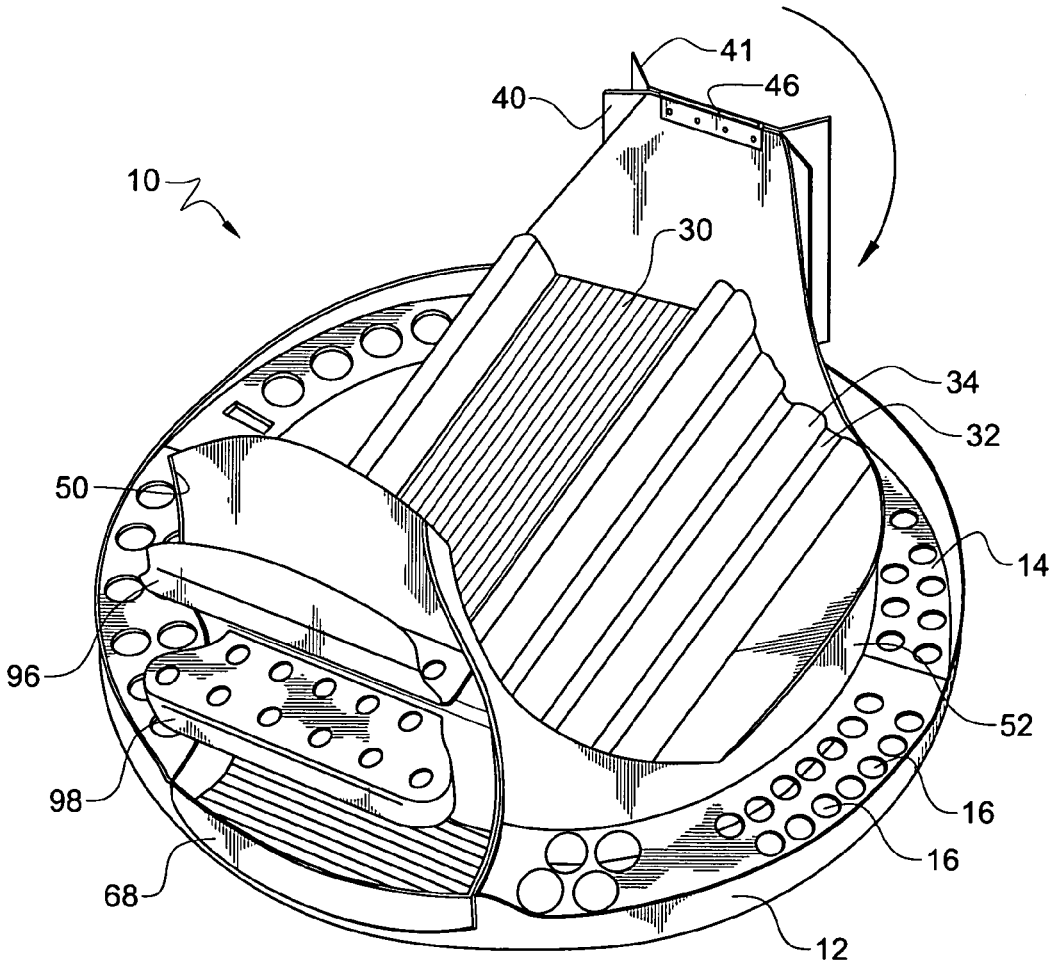
FIG. 14 illustrates a third view of the flying bridge of the tool caddy of the present invention.

Once folded in half, the bridge 40/41 is allowed to fully rotate to the other side of the riser 50 as shown in FIG. 14, keeping the bridge 40/41 out of the way of any tools stored on the central raised platform 30.

Figure 15:
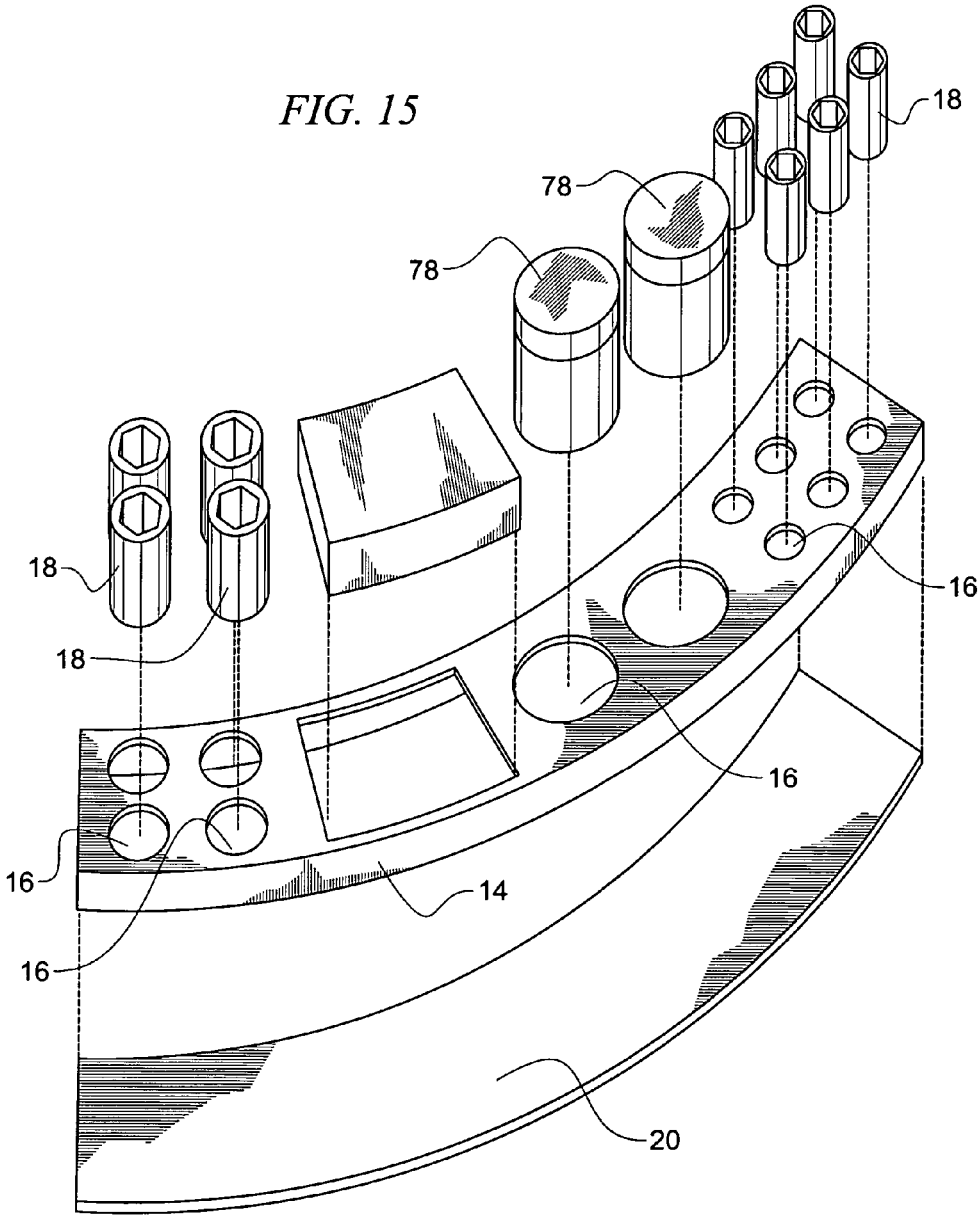
FIG. 15 illustrates an optional magnetic plate of the tool caddy of the present invention.

Referring to FIG. 15, an optional magnetic plate 20 of the tool caddy of the present invention is shown. A magnetic material 20 is affixed to a bottom surface of the circular base 12, under the shaped openings 16 so that any tools made of iron or steel are held firmly in place by the properties of the magnetic material 20.

Figure 16:
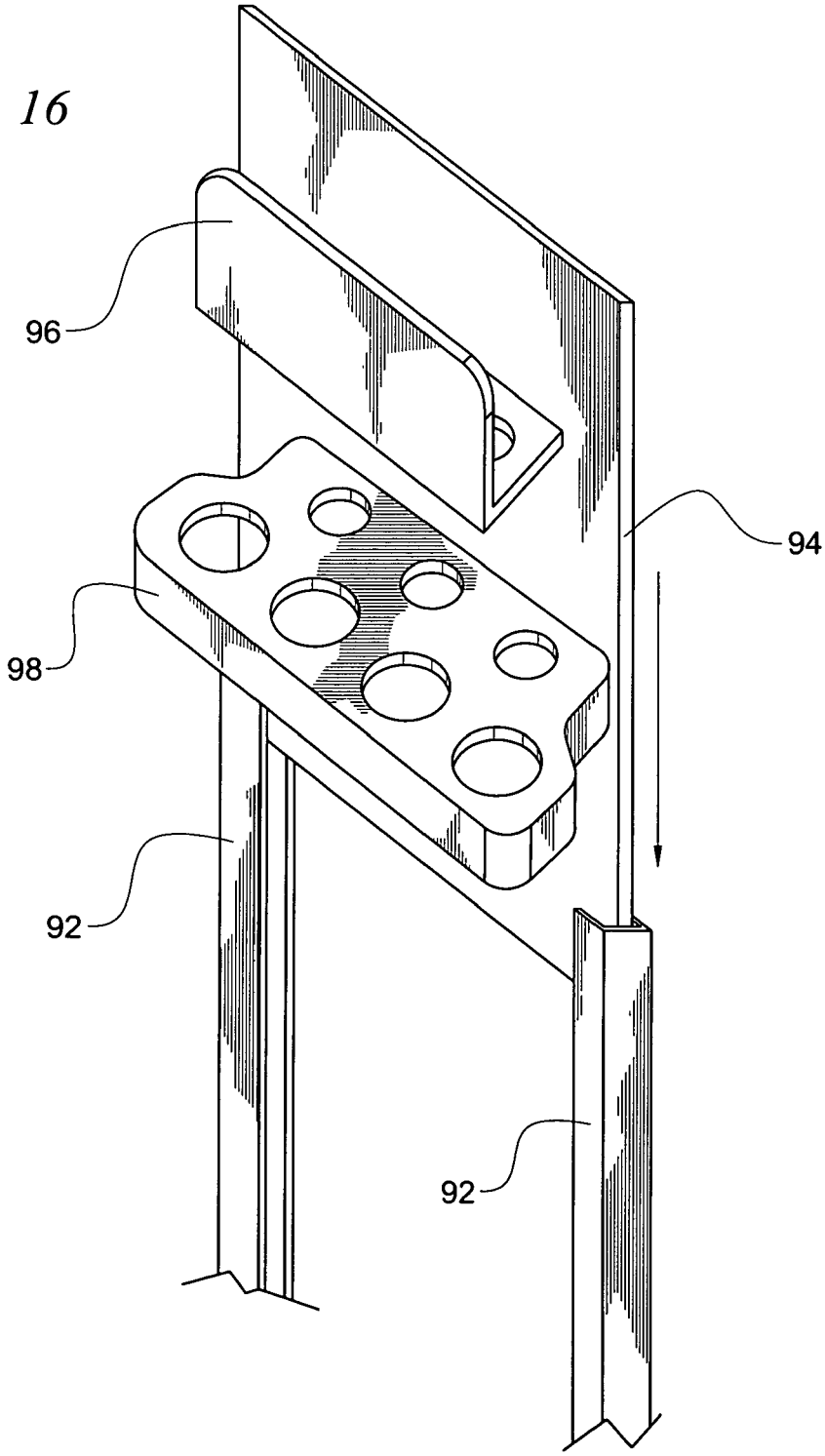
FIG. 16 illustrates a view of the interchangeable side rack of the tool caddy of the present invention.

Referring to FIG. 16, a view of the interchangeable side rack of the tool caddy of the present invention is shown. The upper screwdriver holder 96 and lower screwdriver holder 98 are formed from or affixed to a screwdriver holder plate 94. That assembly slides into and out of screwdriver holder guides 92 so that a different set of screwdriver holders can be inserted. For example, a two screwdriver holder are supplied, one for standard screwdrivers and one for hex nut drivers. In an alternate embodiment, an optional second upper and lower screwdriver holder 96/98 is attached at the opposite side of the tool caddy 10.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A caddy comprising:

a circular base, the circular base affixed to a bearing, the bearing allowing rotation of the circular base;

the bearing comprising a center hub, a circular retainer ring, a bottom plate, a plurality of stabilizers and a plurality of balls, the retainer ring held equidistant from the center hub by a plurality of support rods, the retainer ring having a plurality of circular holes and each of the balls held in place by the retainer ring, an upper surface and a bottom surface of the retainer ring having the stabilizers protruding there from, the retainer ring held in position between a bottom surface of the circular base and the bottom plate by the stabilizers, the stabilizers sized to keep the retainer ring spaced above the bottom plate and below the bottom surface of the circular base;

a plurality of shaped openings on a top surface of the circular base, the shaped openings for holding components;

a central raised platform extending upwardly from the circular base;

at least one angled surface for holding tools, the at least one angled surface connected between the top surface of the circular base and the central raised platform;

two risers extending from the circular base at each end of the central raised platform, the two risers extending higher than the raised central platform; and a bridge, a bottom surface of the bridge being flat, each end of the bridge affixed to one of the risers, the bottom surface of the bridge parallel to and above the central raised platform, a top surface of the bridge forming a tray to hold additional tools;

wherein the bridge comprises two pieces connected to each other with a hinge and the bridge is attached to one of the risers with a second hinge.

2. The caddy of claim 1, wherein the top-to-bottom width of the stabilizers is slightly less than one half of a diameter of the balls.

3. The caddy of claim 1, wherein the balls are made of steel.

4. The caddy of claim 1, wherein the balls are made of plastic.

5. The caddy of claim 1, wherein the at least one angled surface is covered with memory foam.

6. The caddy of claim 1, further comprising a drawer, the drawer situated beneath the central raised platform when closed.

7. The caddy of claim 6, wherein the drawer interfaces with the tool caddy by two side gliders.

8. A tool caddy comprising:

a circular base means, the circular base means affixed to a bearing means, the bearing means allowing rotation of the circular base means;

the bearing means comprising a center hub, a circular retainer ring, a bottom plate, a plurality of stabilizers and a plurality of balls, the retainer ring held equidistant from the center hub by a plurality of support rods, the retainer ring having a plurality of circular holes and each of the balls held in place by the retainer ring, the retainer ring held in position between a bottom surface of the circular base and the bottom plate by the stabilizers, the stabilizers sized to keep the retainer ring spaced above the bottom plate and below the bottom surface of the circular base;

a plurality of shaped opening means on a top surface of the circular base means, the shaped opening means for holding components;

a central raised platform extending upwardly from the circular base means;

a drawer slideably positioned inside a cavity in the central raised platform, the drawer extending outwardly from the central raised platform providing access to the drawer's contents;

a means for holding tools on an outside surface of at least one angled surface, the at least one angled surface connected between the top surface of the circular base means and the central raised platform;

a riser means extending from the circular base means at each end of the central raised platform, the riser means extending higher than the raised central platform; and a bridge affixed to the riser means, a bottom surface of the bridge being flat, the bottom surface of the bridge parallel to and above the central raised platform, a top surface of the bridge forming a tray to hold additional tools;

wherein the bridge comprises two pieces connected to each other with a hinge means and the bridge is attached to one of the riser means with a second hinge means.

9. The caddy of claim 8, wherein a top-to-bottom width of the stabilizers is slightly less than one half of a diameter of the balls.

10. The caddy of claim 8, wherein the balls are made of steel.

11. The caddy of claim 8, wherein the balls are made of plastic.

12. The caddy of claim 8, wherein the means for holding tools comprises memory foam.

13. A tool caddy comprising:

a circular base, the circular base affixed to a lazy susan bearing, the lazy susan bearing having a circular retainer ring rotatably interfaced with the circular base through a plurality of support rods, the support rods connecting the circular retainer ring to a hub and a plurality of balls, each of the balls situated in a plurality of equally spaced holes in the circular retainer ring; the circular retainer ring spaced between the circular base and a lazy susan bottom plate by a plurality of stabilizers thereby holding the balls in place, the stabilizers protruding from a top and bottom surface of the circular retainer ring, the stabilizers protruding slightly less than one-half of a diameter of the balls;

a plurality of shaped openings on a top surface of the circular base, the shaped openings sized to snuggly hold components;

a central raised platform extending upwardly from the circular base;

a drawer slideably positioned inside a cavity of the central raised platform, the drawer extending outwardly from the central raised platform providing access to the drawer's contents;

at least one angled surface configured to hold tools, the at least one angled surface connected between the top surface of the circular base and the central raised platform;

two risers extending from the circular base at each end of the central raised platform, the risers extending higher than the raised central platform; and a bridge affixed to the risers, a bottom surface of the bridge being flat, the bottom surface of the bridge parallel to and above the central raised platform, a top surface of the bridge forming a tray, the tray also holding the tools;

wherein the bridge comprises two pieces connected to each other with a hinge and the bridge is attached to one of the risers with a second hinge.

14. The caddy of claim 13, wherein the at least one angled surface is covered with a nonslip surface.

15. The caddy of claim 13, wherein the balls are made of steel.

16. The caddy of claim 13, wherein the balls are made of plastic.

17. The caddy of claim 13, wherein the at least one angled surface is covered with memory foam.

* * * * *